United States Patent [19]

Sissala

[11] Patent Number: 4,865,157

[45] Date of Patent: Sep. 12, 1989

[54] MOUNTING FOR AN ELEVATOR CAR IN A CAR SLING

[75] Inventor: Mikko Sissala, Hyvinkää , Finland

[73] Assignee: Kone Elevator GmbH, Baar, Switzerland

[21] Appl. No.: 136,124

[22] Filed: Dec. 21, 1987

[30] Foreign Application Priority Data

Dec. 31, 1986 [FI] Finland ..... 865375

[51] Int. Cl.[4] ..... B66B 9/00

[52] U.S. Cl. ..... 187/1 R; 248/581

[58] Field of Search ..... 187/1 R, 20, 95; 248/581, 599, 317; 105/453

[56] References Cited

U.S. PATENT DOCUMENTS

| | | | |
|---|---|---|---|
| 1,873,834 | 8/1932 | Fleckenstein et al. | 248/581 |
| 2,246,732 | 6/1941 | Hymans | 187/1 R |
| 4,113,064 | 9/1978 | Shigeta et al. | 187/1 R |
| 4,428,460 | 1/1984 | Luinstra | 248/317 X |
| 4,660,682 | 4/1987 | Luinstra et al. | 187/1 R |
| 4,713,714 | 12/1987 | Gatti et al. | 248/581 X |

FOREIGN PATENT DOCUMENTS

| | | | |
|---|---|---|---|
| 2523064 | 6/1976 | Fed. Rep. of Germany | 187/1 R |
| 7545 | 1/1977 | Japan | 187/1 R |

*Primary Examiner*—Joseph J. Rolla
*Assistant Examiner*—Kenneth Noland
*Attorney, Agent, or Firm*—Birch, Stewart, Kolasch & Birch

[57] ABSTRACT

A resilient mounting system for an elevator car in a car sling is provided, with the securement of the elevator car being resilient in the lateral direction and substantially more rigid in vertical direction. In prior art elevator car mounting designs, this problem could not be solved simply and efficiently. As taught by the invention, substantially vertically disposed, elongate supporting members are provided with both ends thereof attached to the frame of the car sling or equivalent, the supporting members extending to a securement point on the elevator car in such manner that the supporting members carry at least part of the weight of the elevator car.

5 Claims, 1 Drawing Sheet

MOUNTING FOR AN ELEVATOR CAR IN A CAR SLING

FIELD OF THE INVENTION

The present invention relates to a resilient mounting system for an elevator car in a car sling with resilient securement of the elevator car in the lateral direction and rigid securement of the elevator car in the vertical direction.

DESCRIPTION OF THE RELATED ART

The riding comfort of high-speed elevators deteriorates rapidly with increasing speed of travel. This is due to horizontal vibration of the elevator. The commonest sources of vibration are non-linear guides and oscillations of the car and equalizing ropes, and of the car cables. The impulse which is definitely the greatest arises from bends and deviations from linearity of the guides. Traditionally, attempts have been made to prevent propagation of such impulses to the elevator car by using resilient guide rollers.

Attainment of riding comfort usually implies that the lowest horizontal characteristic frequency of the elevator car is so reduced as to be lower than 2 Hz. If one tries to achieve this merely by reducing the spring constant of the guiding elements, the elevator car will usually have a very lax suspension in the horizontal direction, causing a tendency for the car to tilt and to move out from the centre-line of the guides. This results, for instance, in the risk of inadvertent contact of the catch wedges with the guides (risk of catching), or collision of the car door couplers with well parts during travel. Therefore, the suspension of the elevator car base in the vertical direction has to be kept comparatively rigid in order to avoid excessive tilting. This means that the elevator car should be mounted as resiliently as possible in the horizontal direction but rather rigidly in the vertical direction.

One way in which the lowest transverse characteristic frequency of the system can be reduced is to attach the elevator car resiliently in the lateral direction in a separate frame carrying the elevator car, or in a so-called car sling. Designs of this type are disclosed e.g. in U.S. Pat. Nos. 4,113,064 and 4,428,460.

The conventional guide rollers on the car sling facing towards the well may be so dimensioned as to be comparatively rigid, whereby eccentric loads will not entail the risk of contact between the catch wedges and the guides. Furthermore, the car doors should be attached to the car sling so that the door couplers might not foul any of the stationary apparatus in the well.

A procedure widely practiced at present is to use rubber liners under the elevator car. It is, however, difficult in practice to make such elements rigid enough in the vertical direction if they are to be resilient enough laterally.

On the other hand, since the impulses acting on the elevator are dependent on a plurality of factors, such as the speed of travel, the spacing of the guide mountings, the type of guides employed and the procedure by which they are manufactured, it is difficult to anticipate with accuracy the appropriate rigidity which the mounting members of the elevator car should have. Furthermore, the straightness of the guide line may change with time as the building settles and is subject to deformations. It would therefore be desirable to be able to swiftly alter and adjust the rigidity of the mounting, even after the elevator has been installed.

In order that the elevator car provided with a car sling can yield resiliently in the lateral direction and damp out e.g. impacts in the lateral direction which are due to non-linearity of the guides, but would not tilt to any great extent under eccentric load, one is called upon to solve, within the car sling, problems similar to those which the car sling itself is instrumental in solving in the elevator well. Tilting of the elevator car cannot be permitted in view of the uncomfortable sensation attendant thereon, particularly in high-speed elevators.

In the aforesaid U.S. Pat. No. 4,113,064, the elevator car is allowed to move freely in one direction in the horizontal plane within the car sling, while at the same time the car itself is resiliently carried with reference to the car sling. The elevator car has been suspended in a kind of swing in that it is forced, while moving laterally, to move also vertically on a circular path. The suspension is supported from below in various embodiments of the patent. Since lateral swinging is allowed in one direction only, the structures under the elevator car become rather complicated, even though they do not carry the weight of the elevator car. In addition, the horizontal swinging compensates in this case only for non-linearity of the elevator car guides in the plane of the elevator well walls, whereas non-linearity may equally be present in the direction at right angles to said plane.

In the aforesaid U.S. Pat. No. 4,428,460, linkage mechanisms are used in suspending elevators in the car sling, which present the drawback of complicated design and need of maintenance. Furthermore, the operation of the linkage cannot be regulated other than by altering the geometry of the linkage mechanism, and this is quite cumbersome.

SUMMARY OF THE INVENTION

It is accordingly an object of the present invention to provide a mounting system for the elevator car in the car sling by which the drawbacks of prior art designs are avoided and which meets the above requirements.

The present invention provides a resilient mounting system for an elevator car in a car sling, the system providing resilient securement of the elevator car in the lateral direction and substantially rigid securement in the vertical direction, the system comprising substantially vertically disposed, elongate supporting members, means for securing opposite ends of the supporting members to a frame of the car sling and securement means for securing the supporting members to the elevator car in such manner that the supporting members carry at least part of the weight of the elevator car.

Since the supporting members are vertical, the vertical suspension of the elevator car in the car sling is exceedingly rigid. In the horizontal direction, the members are subject to flexural stress, thus making the horizontal suspension rather more resilient than the vertical suspension. Furthermore, the way in which the supporting members are fixed (i.e. at both ends) guarantees that whenever the elevator car swings it will move laterally only.

The greatest advantage of the invention is that since the nature of the vibration impulses from the elevator guides cannot be accurately anticipated, it is advantageous that the rigidity of the supporting members is easy to adjust. A considerable number of features in the design lend themselves to the basic adjustment, which can be implemented both by appropriate selection of the material, length and configuration of said supporting members, because their modulus of resilience and their flexural resistance have a direct affect on the damping of the horizontal oscillation of the elevator car, and by altering their pre-tension.

In an advantageous embodiment of the invention, the securement means comprise a first cantilever projection provided on the elevator car, the system further comprising a second cantilever projection on the car sling, the supporting members extending from a securement point on the car sling through the first cantilever projection to the second cantilever projection.

This embodiment adds to the ways of adjustment in that one end of the supporting members may also be provided with adjusting means.

In another advantageous embodiment of the invention, the securement means include means for adjusting the stress conditions of the supporting members.

The fine control required, e.g. after basic adjustment, is easy to accomplish by means of the arrangement of this embodiment.

Another advantageous embodiment of the invention includes resilient means provided at the second cantilever projection for regulating the transverse rigidity of the supporting members.

A particular feature of this embodiment is that the lateral resilience response curve of the supporting members can be made progressive with the aid of a spring. By regulating the tension of the spring, the lowest characteristic frequency of the system can also be adjusted.

BRIEF DESCRIPTION OF THE DRAWINGS

The invention is described in the following in detail with the aid of an example, reference being made to the drawings attached, wherein.

DESCRIPTION OF THE PRIOR ART

Figure 1:
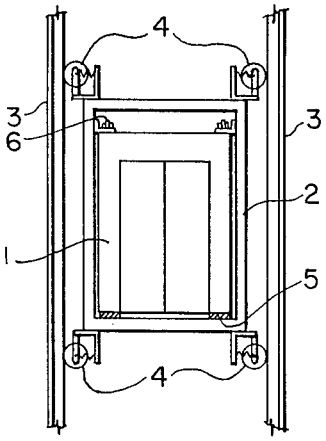
FIG. 1 PRIOR ART
FIG. 1 presents a prior art mounting for an elevator car in a car sling.

In FIG. 1, an elevator car 1 has been placed in a car sling 2. The guides in the elevator well (not shown) are indicated by reference numeral 3, and guide wheels, with a lateral spring action, by reference numeral 4. Under the elevator car are disposed resilient pads 5 or the equivalent, usually of rubber, and the car is attached at its top to the car sling by means of flanges 6. The resilient pads 5 are rubber insulators; it is difficult to make them sufficiently rigid in the vertical direction if they are to be resilient enough laterally. It will be understood that the material of the resilient pads should have anisotropic resilient characteristics.

DESCRIPTION OF THE PREFERRED EMBODIMENTS

Figure 2:
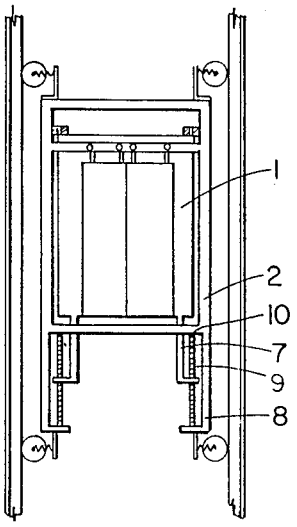
FIG. 2 presents a mounting for an elevator car in a car sling, according to an advantageous embodiment of the present invention.

FIG. 2 illustrates means taught by the present invention for mounting the elevator car in the car sling, four cantilver projections 7 being provided on the corners of the bottom of the elevator car 1, as well as corresponding securement points for the supporting members, in the lower part of the car sling 2, on the frame of the sling 2 and of the cantilever part 8. The minimum number of supporting members is three and, in modifications of the present embodiment, they may equally be located in conjunction with the upper part of the elevator car.

As shown in FIG. 2, which illustrates the left-hand side of the structure of FIG. 2 in greater detail, the supporting members 9 extend through the cantilevers 7 of the elevator car 1 and are fixedly welded thereto. The cantilever projections 8 on the car sling 2 are integral with the securement points 10 of the supporting members 9 on the frame of the car sling.

It will be seen that each cantilever projection 7 of the elevator car consists of a vertical part 11 and a horizontal part 12, the supporting rod 9 having been carried through a hole piercing the latter and fixedly welded thereto. Each rod 9 is thus structurally divided into two parts A and B, the horizontal rigidity of the rods 9 depending on the ratio of their lengths. The horizontal rigidity is moreover dependent on the modula of resilience of parts A and B, on their flexural resistances and on the pre-stresses with which they are loaded at points 10 and 13. The modulus of resilience enters the matter for the reason that when the elevator car and its cantilever projection 7 move in the horizontal plane, thus bending the supporting member 9, a tension force is at the same time directed on the supporting member at its securement points 10 and 13 because there is not space enough for it to bend in the through-holes provided in the structures of the car sling, as a result of which it will experience the bending as a tensile stress.

Nuts provided at points 10 and 13 enable fine adjustment, or late correction, of the axially prestressed state of the rods A and B and thereby of the horizontal rigidity of the supporting member 9, without any need to detach or replace components.

Figure 3:
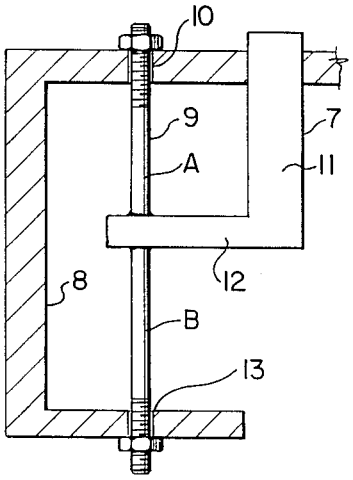
FIG. 3 shows a portion of the mounting of FIG. 2 on a larger scale.
Figure 4:
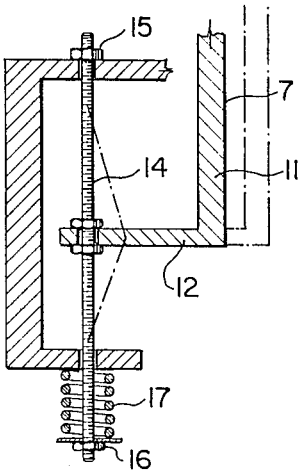
FIG. 4 presents a modification of the embodiment of FIG. 2.

FIG. 4 is an illustration, equivalent to FIG. 3, of another embodiment of the invention. In this case the supporting member comprises a steel cable or another supporting member 14 presenting a low flexural resistance and fixed between the elevator car and the car sling in the manner described in the foregoing. The prestressing can be adjusted by stretching nuts 15 and 16 in the manner already described. The passage of the steel cord through the cantilever projection 7 of the elevator car has been implemented by a vertically adjustable screw juncture, which structurally divides the steel cord into two parts, A′ and B′.

Since, however, a steel cable has virtually no flexural resistance, it is advisable to insert a compression spring 17 to control the horizontal rigidity of the steel cord 14. This spring, appropriately preloaded by means of a nut 16, provides for suitable resilient yielding in response to minor movements of the elevator car, whereas its total compression causes the lateral spring force to increase abruptly, the parts A′ and B′ having considerably higher axial rigidity than the spring. Dotted lines indicate, by way of example, the displacement of the elevator car components and the steel cord when they are in the extreme right-hand position.

By adjusting the tension of the spring 17, the lowest characteristic frequency of the system can be regulated, and the maximum lateral displacement of the car is set by changing the compression length of the spring. A spring other than a helical spring may equally be contemplated or, for instance, a shock absorber, in which case the progression becomes a continuous function of the compression.

It will be obvious to those skilled in the art that different embodiments of the invention are not restricted to the above examples and that they may vary within the scope of the claims presented below.

For instance, the supporting members may alternatively be located in the upper part of the elevator car, or in the upper as well as the lower part.

I claim:

1. A resilient mounting system for an elevator car in a car sling, said system providing resilient securement of the elevator car in the lateral direction and substantially rigid securement in the vertical direction, said system comprising:

substantially vertically disposed, elongate supporting members;

means for securing opposite ends of each said supporting member to a frame of said car sling; and securement means for securing said supporting members to said elevator car in such a manner that said supporting members carry at least part of the weight of the elevator car said securement means comprising a first cantilever projection provided on said elevator car, said system further comprising a second cantilever projection on said car sling, and said supporting members extending from a securement point on said car sling through said first cantilever projection to said second cantilever projection.

2. A resilient mounting system according to claim 1, wherein said supporting members comprise metal rods.

3. A resilient mounting system according to claim 1, wherein said supporting members comprise metal cables.

4. A resilient mounting system according to claim 1, further comprising resilient means provided at said second cantilever projection for regulating the transverse rigidity of said supporting members.

5. A resilient mounting system for an elevator car in a car sling, said system providing resilient securement of the elevator car in the lateral direction and substantially rigid securement in the vertical direction, said system comprising:

substantially vertically disposed, elongate supporting members;

means for securing opposite ends of each said supporting member to a frame of said car sling; and securement means for securing said supporting members to said elevator car in such manner that said supporting members carry at least part of the weight of the elevator car said securement means including means for adjusting the stress condition of said supporting members.

* * * * *